US012643198B2

(12) United States Patent
Champaigne et al.

(10) Patent No.: US 12,643,198 B2
(45) Date of Patent: Jun. 2, 2026

(54) SYSTEMS AND METHODS FOR ALMEN STRIP CORRECTION

(71) Applicant: Electronics, Inc., Mishawaka, IN (US)

(72) Inventors: Jack Champaigne, Mishawaka, IN (US); David Kirk, Kenilworth (GB)

(73) Assignee: Electronics, Inc., Mishiwaka, IN (US)

( * ) Notice: Subject to any disclaimer, the term of this patent is extended or adjusted under 35 U.S.C. 154(b) by 430 days.

(21) Appl. No.: 18/309,411

(22) Filed: Apr. 28, 2023

(65) Prior Publication Data

US 2023/0356358 A1 Nov. 9, 2023

Related U.S. Application Data

(60) Provisional application No. 63/339,929, filed on May 9, 2022.

(51) Int. Cl.
*B24C 1/10* (2006.01)

(52) U.S. Cl.
CPC ..... *B24C 1/10* (2013.01)

(58) Field of Classification Search
CPC ..... B24C 1/10; B24C 7/007; B24C 7/0015; B24C 7/0053
USPC ..... 702/85
See application file for complete search history.

(56) References Cited

U.S. PATENT DOCUMENTS 2,350,440 A 6/1944 Almen
8,091,406 B1 * 1/2012 Champaigne ..... C21D 7/02 73/11.02

FOREIGN PATENT DOCUMENTS

WO WO-2021245074 A1 * 12/2021 ..... G01L 5/0047

* cited by examiner

*Primary Examiner* — Sujoy K Kundu
(74) *Attorney, Agent, or Firm* — Greenberg Traurig, LLP

(57) ABSTRACT

A method for calibrating a shot peening device includes receiving, by a controller, one or more parameters representative of the shot peening device, receiving, by the controller, one or more parameters representative of a test strip for use with the shot peening device, determining, by the controller, a compensation value for the test strip based on the one or more parameters representative of the shot peening device and on the one or more parameters representative of the test strip, receiving, by the controller, an arc height of the test strip following an introduction of the test strip into a shot stream generated by the shot peening device, generating, by the controller, a compensated curvature value based on the compensation value and the arc height, and presenting, by the controller, a calibration suggestion based on the compensated curvature value.

23 Claims, 11 Drawing Sheets

FIG.3–CORRELATION OF A, N, AND C STRIPS AS CHECKED ON AN ALMEN GAGE No.2

SYSTEMS AND METHODS FOR ALMEN STRIP CORRECTION

CROSS-REFERENCE TO RELATED APPLICATIONS

This application is a non-provisional conversion of U.S. Pat. App. No. 63/339,929 entitled "SYSTEMS AND METHODS FOR ALMEN STRIP CORRECTION," filed May 9, 2022, the contents of which are incorporated in their entirety and for all purposes.

TECHNICAL FIELD

This disclosure generally relates to shot peening. In particular, this disclosure relates to the determination of shot peening intensity using thin strips of steel (e.g., also referred to herein as Almen strips, which may be made of Society of Automotive Engineers (SAE) 1070 steel).

BACKGROUND

Almen strips are test coupons used to determine the intensity of impacts impinged by a high-velocity stream of hard particles (e.g., media, shot, etc.) used for shot peening. These test strips are described in U.S. Pat. No. 2,350,440, which is hereby incorporated by reference in its entirety. Shot peening intensity is determined by blasting several Almen strips with shot and observing the resultant curvature of the strip. A strip continues to increase its curvature as it accumulates more dents and impacts. As the strip becomes saturated with dents, the amount that the curve increases or deepens (e.g., a rate of change of an arc height of the curve) will decrease, indicating that the strip is becoming saturated. Standard industry practice for this test is to identify a benchmark value for the shot peening intensity at a saturation point of the Almen strip, which is defined as a point where a doubling of blast time of a strip yields less than a ten percent increase in the curvature of the Almen strip. As such, at the saturation point, surface saturation is considered to have occurred and continued peening yields little additional benefit.

DETAILED DESCRIPTION

Standard industry practice does not account for variations in the Almen strips themselves, also referred to herein as strips, or test strips. For example, prior to being blasted with shot, some strips may already be slightly curved (e.g., having pre-bow curvature), which can affect the saturation point or final curvature value of the strips. In another example, the test strips may be made of different materials, or may have slightly variable hardness or thickness within a batch of strips due to differences in the manufacturing process. The curvature value may also be dependent on size of the shot, for which current practices do not account.

Figure 1:
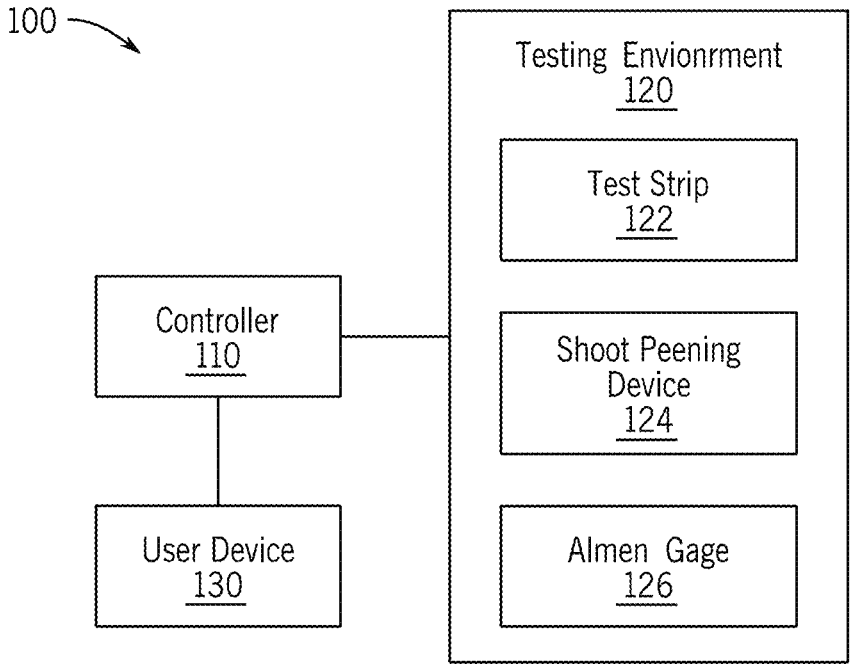
FIG. 1 is a block diagram of an example system for calibrating a testing environment.

Referring now to the drawings, wherein like numerals refer to the same or similar features in the various views, FIG. 1 is an example system 100 for calibrating a testing environment 120. As shown, the system 100 includes a controller 110 in communication with the testing environment 120 and with a user device 130. The testing environment 120 includes a test strip (or strips) 122, a shot peening device 124, and an Almen gage 126. The test strips 122 are any appropriate Almen strip or similar piece of metal configured to respond to shot peening. The shot peening device 124 is any suitable device capable of propelling shot (or similar media) at a defined velocity. The Almen gage 126 is any measurement device capable of measuring (e.g., determining) an arc height or other metric for curvature of the test strip 122.

Figure 2:
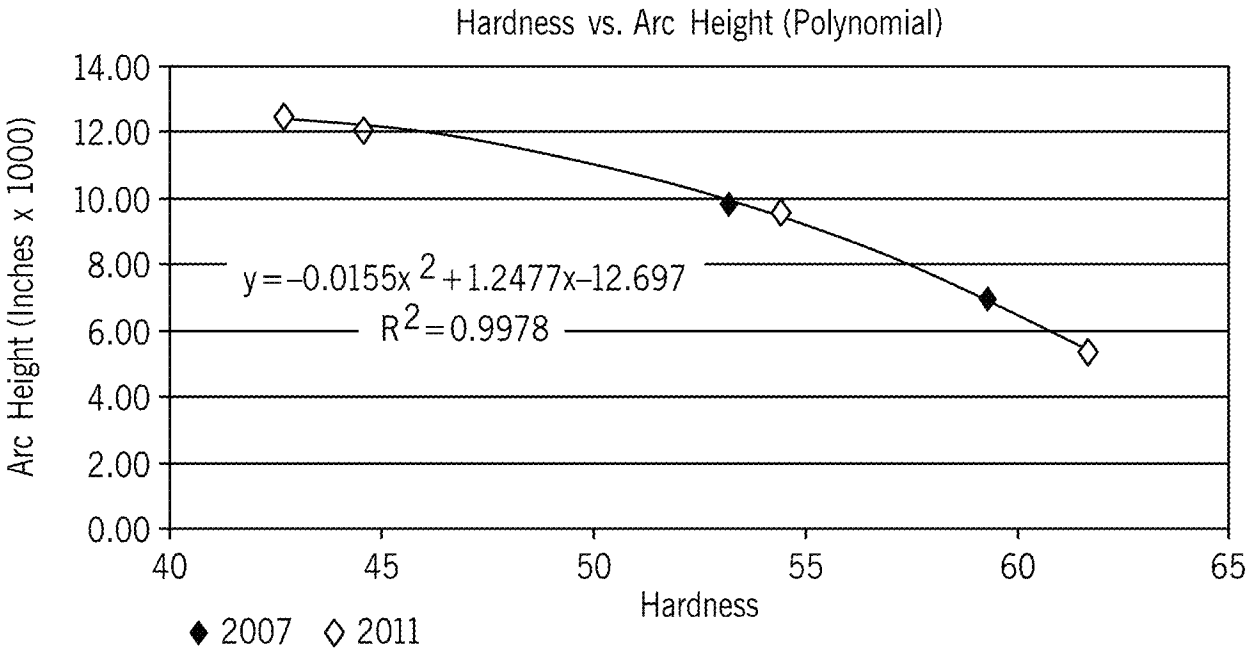
FIG. 2 is a plot of arc height as a function of Almen strip hardness.
Figure 3:
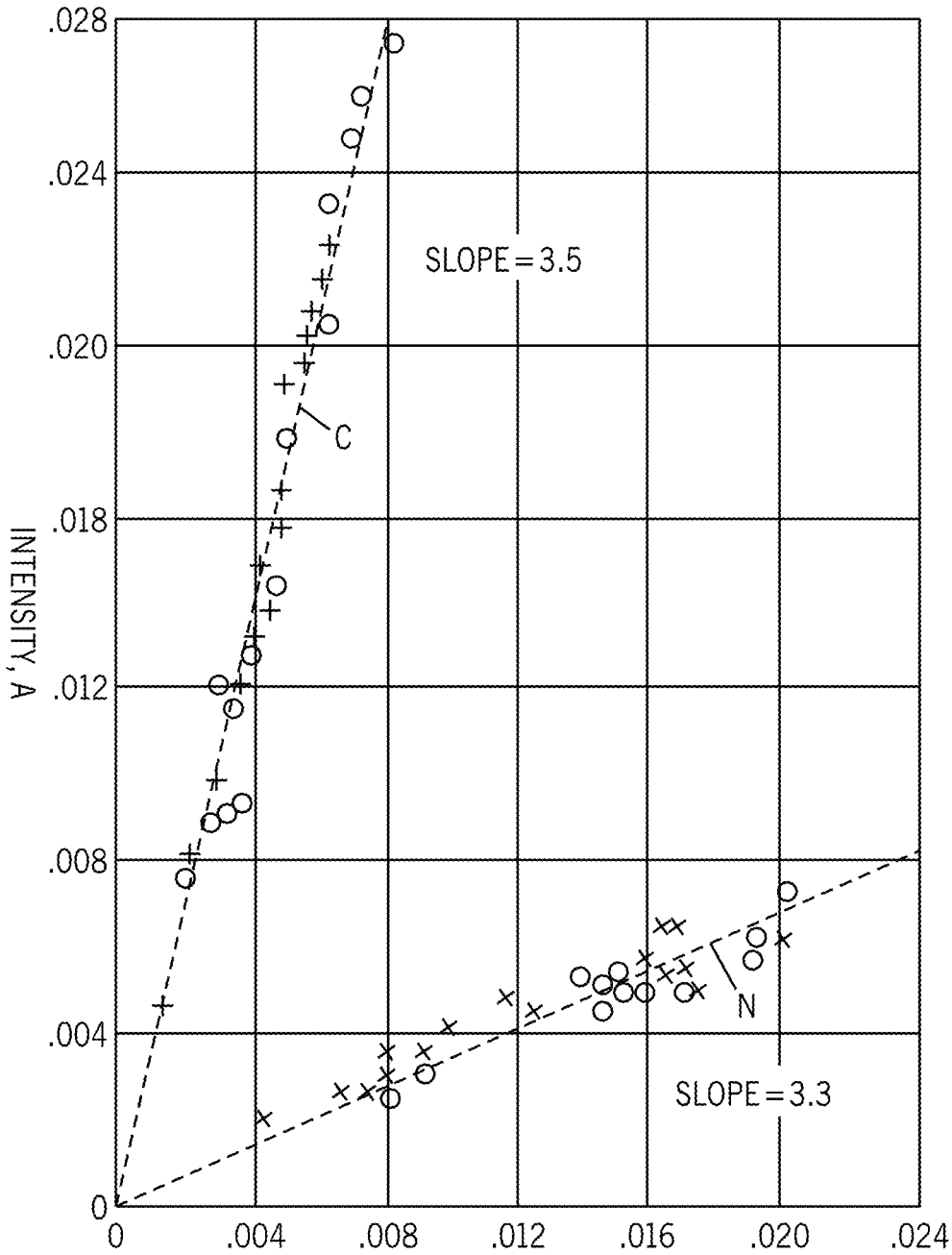
FIG. 3 is a plot of curvature values for C or N strips as compared to A strips at an equal shot peening intensity.

FIG. 2 is a plot of arc height at a saturation point of a test strip as a function of Almen strip hardness. As shown in FIG. 2, arc height decreases as hardness increases, such that hardness does influence arc height performance. However, hardness was not previously accounted for in intensity determinations. Instead, thickness is the primary parameter for Almen strips, and comes in three levels: N, A, and C. N strips are the thinnest and are used for the most low-intensity peening, A strips are mid-range and used for moderate peening, and C strips are the thickest and are used for high-intensity peening. FIG. 3 is a plot of curvature values for C or N strips as compared to A strips at an equal shot peening intensity. As shown in FIG. 2, a shot peening intensity that produces a curvature of 0.008" on a C strip would produce a 0.028" curvature on an A strip, while a shot intensity that produces a curvature of 0.024" on an N strip would produce only a 0.008" curvature on an A strip.

Since hardness is not accounted for in current shot peening intensity measurements/tests, the result of an Almen strip test may be adjusted based on a hardness measurement of the test strip to get a more accurate or consistent Almen strip test result. The data in FIG. 1 specifically may be used to adjust measured saturation points to be normalized for hardness of the strip itself. In this way, more accurate/consistent Almen strip tests may be performed, as different levels of hardness in strips may be accounted for. In various examples, the hardness of the Almen strips may be measured before or after the shot peening intensity tests are performed. In this way, the hardness of the strips may be measured before being used (e.g., at a manufacturer of the strips' facility) or after being used (e.g., to account for hardness of a strip after the tests are performed and unexpected initial results are observed that do not account for hardness). Where hardness is measured after the shot peening intensity test with the strips is already performed, the hardness may be measured using the back of the test strip that was not exposed to shot peening during the test.

Figure 4:
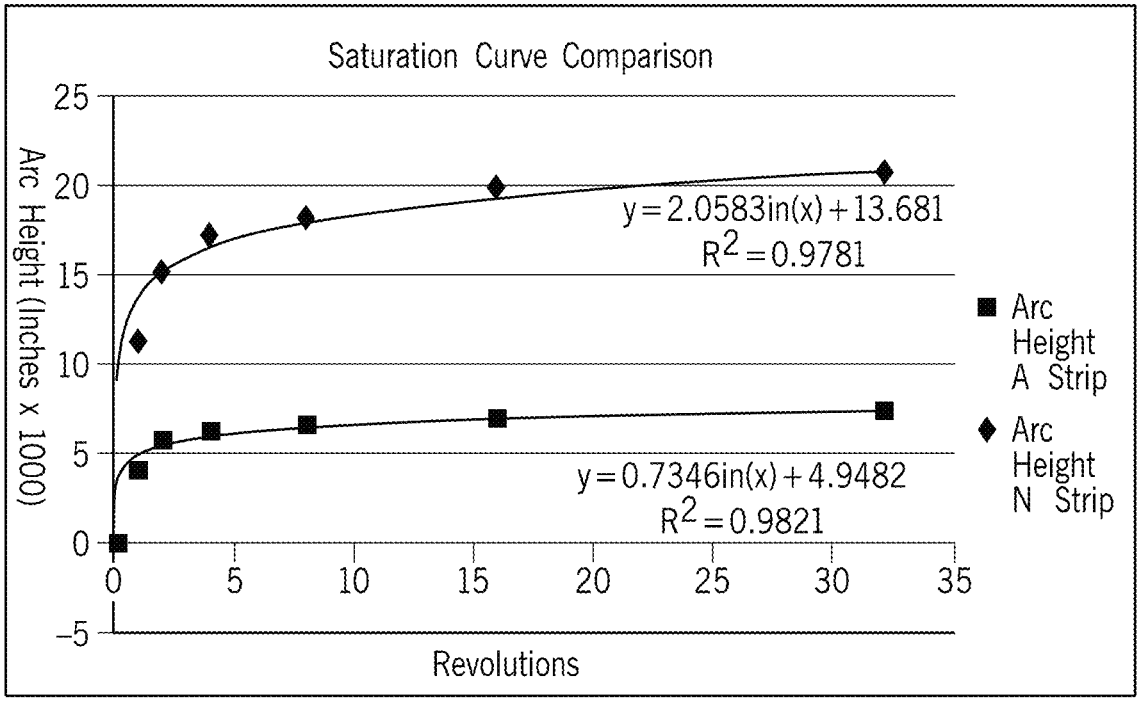
FIG. 4 is a plot of arc heights for an A strip and an N strip as a function of revolutions.
Figure 5:
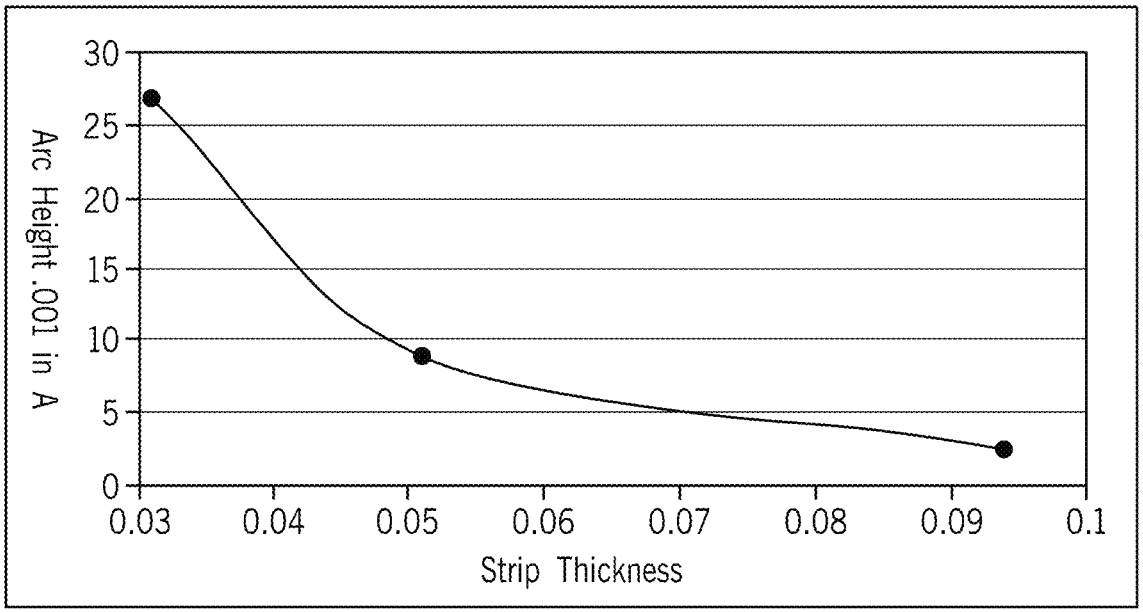
FIG. 5 is a plot of arc height in an A strip as a function of strip thickness at the hundredths decimal place.

FIG. 4 is a plot of arc heights for an A strip and an N strip as a function of revolutions (e.g., rounds of shot peening). As shown in FIG. 4, the N strips have higher arc heights for all amounts of revolutions, which indicates that strip thickness also has a measurable effect on final curvature. FIG. 5 is a plot of arc height in an A strip as a function of strip thickness at the hundredths decimal place. Strip thickness is generally controlled in the manufacturing process to a thickness with a range of ±0.001", so arc height may be compensated for at the ±0.01" level. As such, like hardness as discussed above, thickness may also be taken into account to adjust and normalize the results of a shot peening intensity test based on the thickness of a test strip. In various examples, the specific thickness of the test strip may be measured before or after shot peening intensity test is performed.

In various examples, other factors may also be considered for an Almen test strip, so that the results of a shot peening intensity test may compensate for various factors that may include, thickness, hardness, and/or other factors. For example, a media size of the shot, media type, media hardness, or any other aspect or characteristic of the media that is used to shot peen the Almen strips may be measured and compared to Almen strip saturation points to determine whether a test result value may be adjusted or compensated for different types, sizes, etc. of media used in the test.

By factoring in thickness and/or hardness of a particular Almen strip and/or media size or other characteristic of particular shot, one or more compensation factors may be applied to the final curvature value (e.g., the saturation value of a strip) to generate a more accurate reflection of shot peening intensity. Furthermore, because the compensation takes thickness into account, an intensity test may be performed using any of N, A, or C strips, or even strips that are differently sized than a typical N, A, or C strip.

Figure 6:
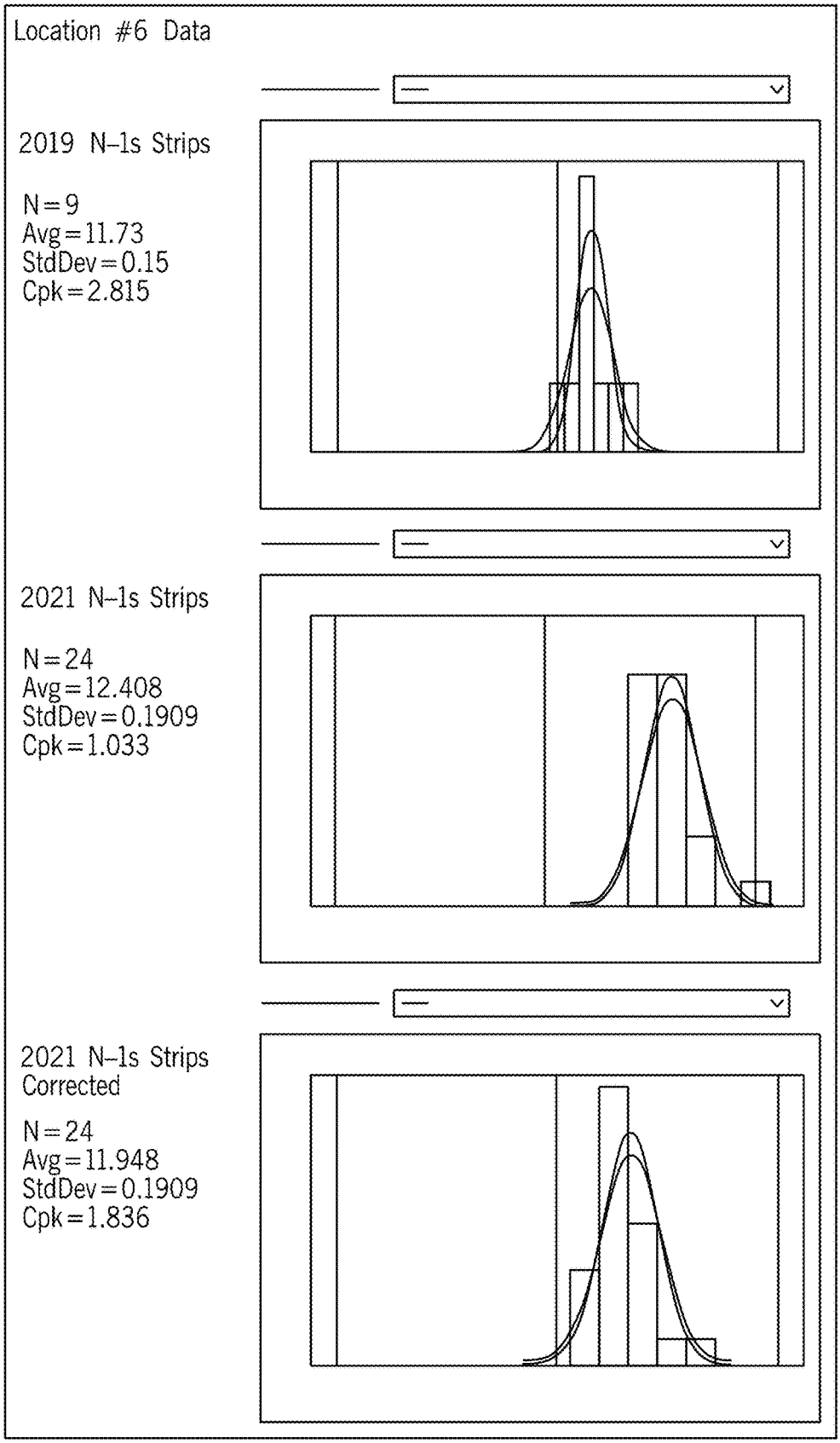
FIG. 6 are plots of arc height readings from two batches of strips and of arc height readings from one of those batches with the compensation applied.

FIG. 6 includes plots of arc height readings from two batches of N strips and of arc height readings from one of those batches with the herein described compensation applied. As shown in FIG. 6, the 2019 N strips may have different average, standard deviation, mean, etc. saturation values than the 2021 N strips tested. However, the 2021 N strips may have been measured to have a different hardness and/or thickness than the 2019 N strips for example. As such, the difference in hardness may be measured between the 2019 and 2021 N strips to apply a compensation factor to the 2021 N strips results so that the results of the 2021 N strips may be more fairly compared to the 2019 N strips. By correcting or compensating the 2021 N strips' saturation points as shown in the bottom graph of FIG. 6 according to the hardness and/or thickness differences in the strips, the 2021 N strips results may therefore more closely match the results of the 2019 N strips. In other words, the compensated values may more closely follow a normal distribution, which indicates a more accurate testing sample.

Test strip response may be based on three sets of parameters: machine parameters (e.g., regarding the shot peening device), strip parameters (e.g., regarding the test strip itself), and operator parameters (e.g., regarding a user of the device). The machine parameters include a quality of the shot, a size of the shot, a type of the shot, a hardness of the shot, an air pressure of the device, a humidity of the pressurized air, a size of a nozzle of the device, a wear of the nozzle, a size of a blast hose of the device, a wear of the blast hose, an ambient barometric pressure, an arrangement of the device (e.g., a position relative to the test strip, an angle relative to the test strip, etc.), an elapsed time since initiating the test peening, and an intensity level of the shot peening. For example, a higher humidity in the pressurized air could cause some media to clump in the blast hose, and a lower humidity in the pressurized air could cause static electricity to build up in certain media. Some of these parameters are unique to a specific test or testing environment, and are determined at the time of the test. Other parameters (e.g., the size of the blast hose) are particular to the device itself, and may hold steady throughout multiple tests.

The strip parameters include a thickness of the strip, a hardness of the strip, a width of the strip, a length of the strip, a chemical composition of the strip (e.g., ratio of compounds making up the steel alloy), a surface quality (e.g., roughness) of the strip, a magnetic property (e.g., resistivity, coercivity, etc.), a residual surface stress of the strip (e.g., stress embedded in the strip as a result of the initial manufacturing process), a subsurface residual stress of the strip (e.g., stress embedded under the strip as a result of the initial manufacturing process), an edge form (e.g., shape of the edge) of the strip, a decarburization level of the strip (e.g., how much carbon at the surface-adjacent level of the strip has evaporated), and a pre-bow amount (e.g., initial arc height) of the strip. Each of these parameters is particular to an individual test strip, although some parameters (e.g., chemical composition, edge form, etc.) may be consistent across a set or grouping of test strips. These parameters are known and/or set at a time of production of the strips, and may be stored in a central database for future retrieval. For example, a packaging of a set of test strips may have a printed code (e.g., QR code, bar code, text string) that can be interacted with to retrieve the set-specific parameters. The other parameters are then derived by measuring the test strip itself.

The operator parameters include an accuracy of the Almen gage (e.g., the measurement device for the test strip), whether the arc height measurement is for the concave side of the strip (e.g., the side that the shot impacts) or for the convex side of the strip (e.g., the side opposite of the impact), a torque of the screw(s) holding the test strip in place (e.g., given a proximity of the screws to the reference points for measurement), and a flatness of the test strip holder itself. Each of these parameters is specific to a particular test, and measurements may be taken prior to initiating the test in order to establish the full array of parameter values.

As a process, a specific test strip is first measured for one or more of the strip parameter, the shot for use in the test are measured for one or more machine parameters, the shot peening device is set based on one or more machine parameters, and one or more operator parameters are determined. Once the parameters that require specific measurements are determined, other machine, strip, or operator parameters may be retrieved from the central database (e.g., by scanning a QR code on the packaging of the test strips, etc.) The strips may then be exposed to the stream of shot from the shot peening device, and the final curvature (e.g., at saturation) value is measured and recorded. This final curvature value is an arc height based on a difference between an initial position of the test strip and a farthest point of the post-test curve of the test strip.

Based on the machine parameters, the strip parameters, and/or the operator parameters, a compensation value is determined. The compensation value is determined based a pre-determined effect that each parameter would be expected to have on the measured arc height. For example, if the pre-bow value is 0.2 mm, which would indicate that the test strip was initially arced (prior to the shot peening) by 0.2 mm, the compensation value would incorporate this pre-bow value as an adjustment, given that the arc height would need to reflect a different initial value than '0.' In another example, if a greater thickness value of the test strip is determined to be associated with relatively smaller arc heights, the compensation value would reflect this and would adjust the measured arc height based on the relative thickness (or thinness) of the particular test strip.

The compensation value is then applied to the measured arc height value to generate a compensated curvature value. This process may be repeated to generate a set of compensated curvature values, which would be indicative of the performance of the shot peening device agnostic of any external factors. Based on the compensated curvature values, the intensity of the shot peening may be adjusted by affecting a change in the shot peening device (e.g., changing media flow rate, blasting air pressure, rotations speed of blast wheel, etc.) to get a desired shot peening intensity based on the compensated test results.

Figure 7:
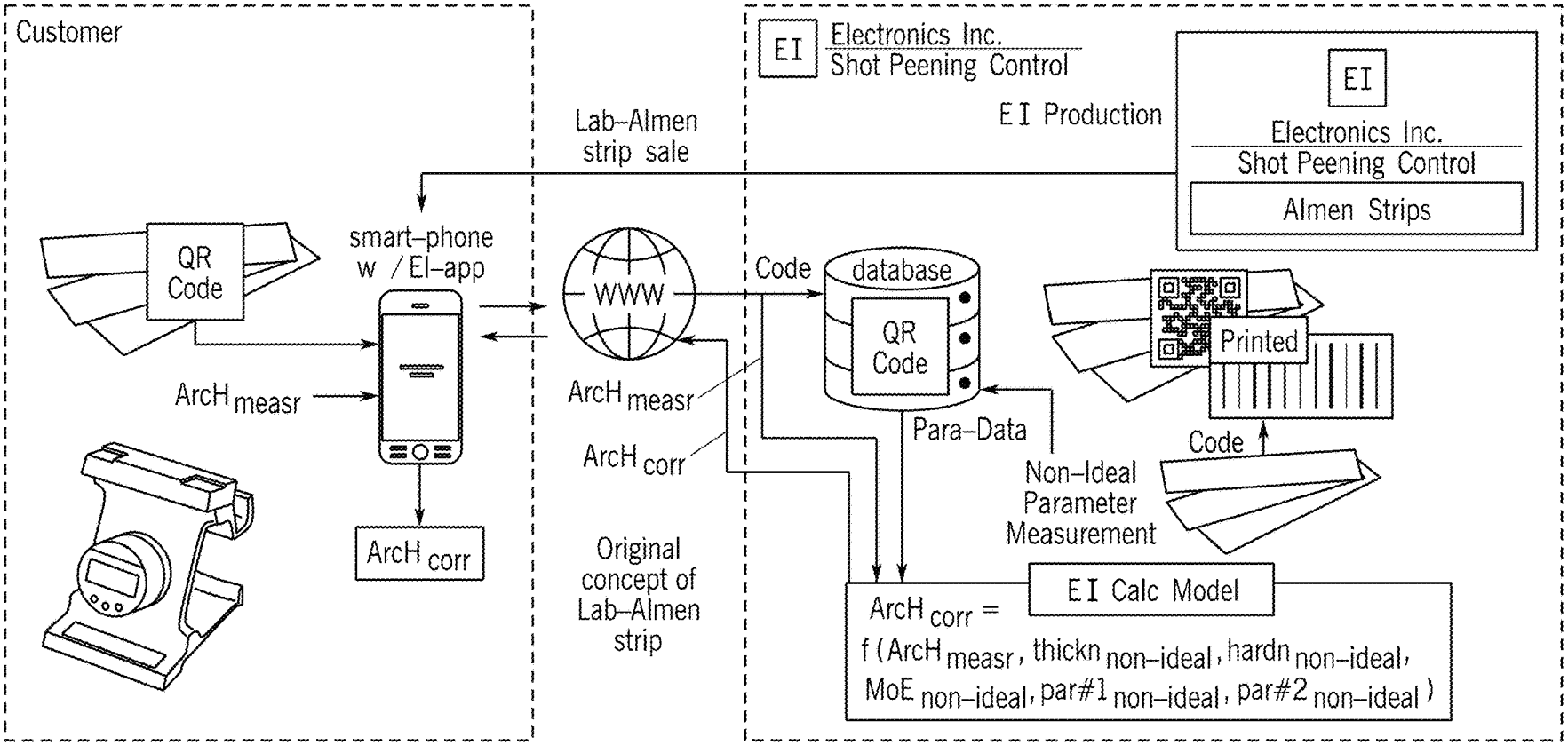
FIG. 7 is an example embodiment of applying compensation to a testing environment using the system of FIG. 1.

FIGS. 7-12 are example embodiments of applying a compensation as described herein. As shown in FIG. 7, Almen strips may be manufactured and sold, and the manufacturer may measure and record in a database various parameters of an Almen strip, such as hardness and thickness of Almen strips). Upon using the Almens strips, a customer may (e.g., using user device 130) scan a barcode, enter a unique identifier on the strip, scan a QR code, or similar so that the strip may be identified, and send that information to a manufacturer's server via the Internet or other network so that the manufacturer's server may apply a correction factor based on a calculation/compensation model. This model, which is embedded on or processed by the controller 110, may implement correction/compensation factors as described herein to account for deviations in thickness, hardness, etc. of a strip from an ideal or desired thickness, hardness, etc.

As such, the manufacturer's system may receive identification of an Almen strip from a customer, either via a QR code printed on the strip or via an identifying number or code. That identifying information may be associated with various properties of the strip, such as parameters of the strip manufactured at the manufacturer's facility. In various examples, scanning of a code may populate a calculator (e.g., on a mobile app, on a computer, in a calculator embedded in a measuring tool, etc.) with the associated properties for calculating the compensation factor. In various examples, the identifying information may be directly associated with the compensation factor that was pre-determined by a backend system, such that scanning or entering the code provides the compensation factor directly without entry of other data. In various examples, the measured saturation point or curvature data may also be input by the customer, such that the manufacturer's backed system applies the correction or compensation to the measured value and sends back the corrected measurement. In this way, a measurement of a used test strip may be adjusted by a manufacturer device without a customer device being exposed to or using the correction factor or calculation model, the initial strip measurements (e.g., hardness, thickness measured at the manufacturer before delivering the strip to customer), etc.

As such, the controller 13—may receive particular Almen strip data, perform (or receive) measurements regarding certain properties of the Almen strip (e.g., thickness, hardness, initial arcing, etc.). From there, the controller calculates a compensation factor based on the before and after measurements/properties of the test strips 122. These properties and/or the calculated compensation factor may also be entered into a database to be associated with a particular strip (or particular batch of strips). A QR code (or similar identifying code) may be generated in order to associate a particular strip with the stored information. As such, the QR code may provide a link to the database or may pull the information directly from the database. The QR code may then be printed and affixed to the particular strip (or batch of strips).

Figure 8:
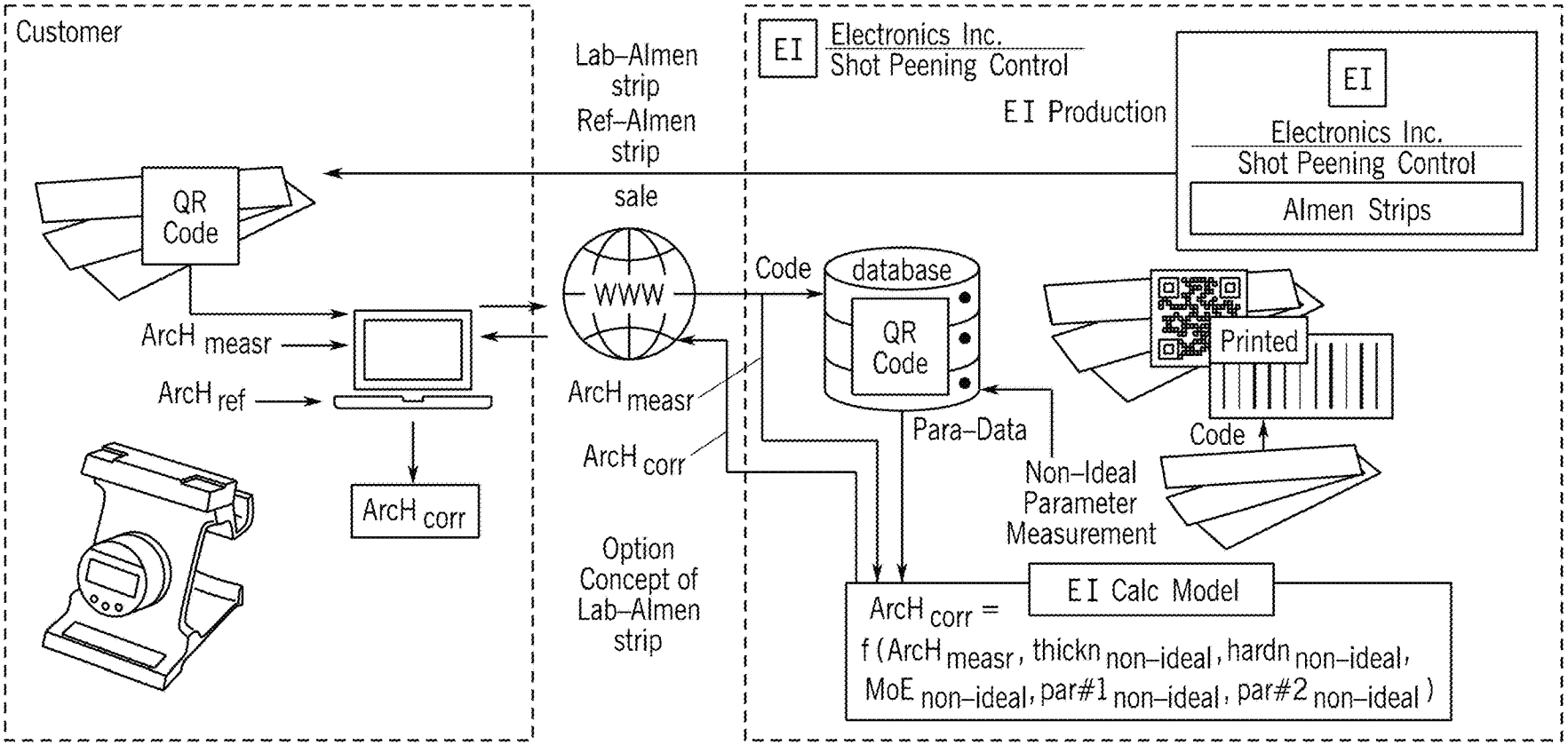
FIG. 8 is an example embodiment of applying compensation to a testing environment using the system of FIG. 1.

FIG. 8 shows an example similar to FIG. 7, where a reference test strip 122 is also used/identified either by the customer or the manufacturer. In this way, a test strip 122 used by the customer in a shot peening intensity test may be set or used as the reference or ideal test strip for the other strips to be normalized to. In other words, instead of normalizing all test strips to a strip of ideal measurements, one of the strips used by the customer may be used as the reference to reduce the degree to which the saturation values may be compensated/corrected. In other words, a strip from a batch that is being used by a customer may be used as a reference so as to correct test results based on one of the strips actually being used in the test. FIG. 8 also demonstrates use of a laptop computer instead of a mobile smartphone device as in FIG. 7. However, in various examples, any type of device may be used.

Figure 9:
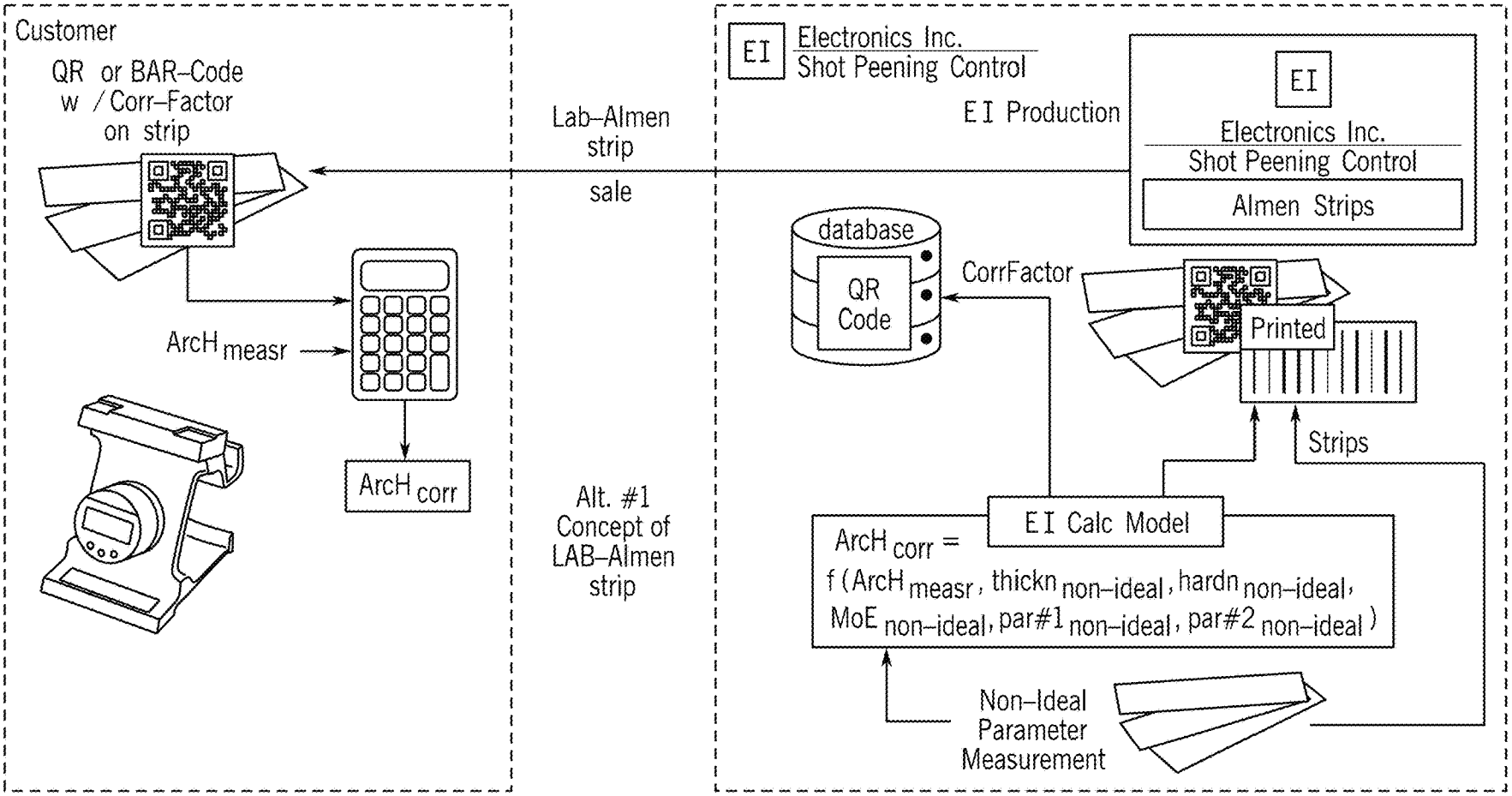
FIG. 9 is an example embodiment of applying compensation to a testing environment using the system of FIG. 1.
Figure 10:
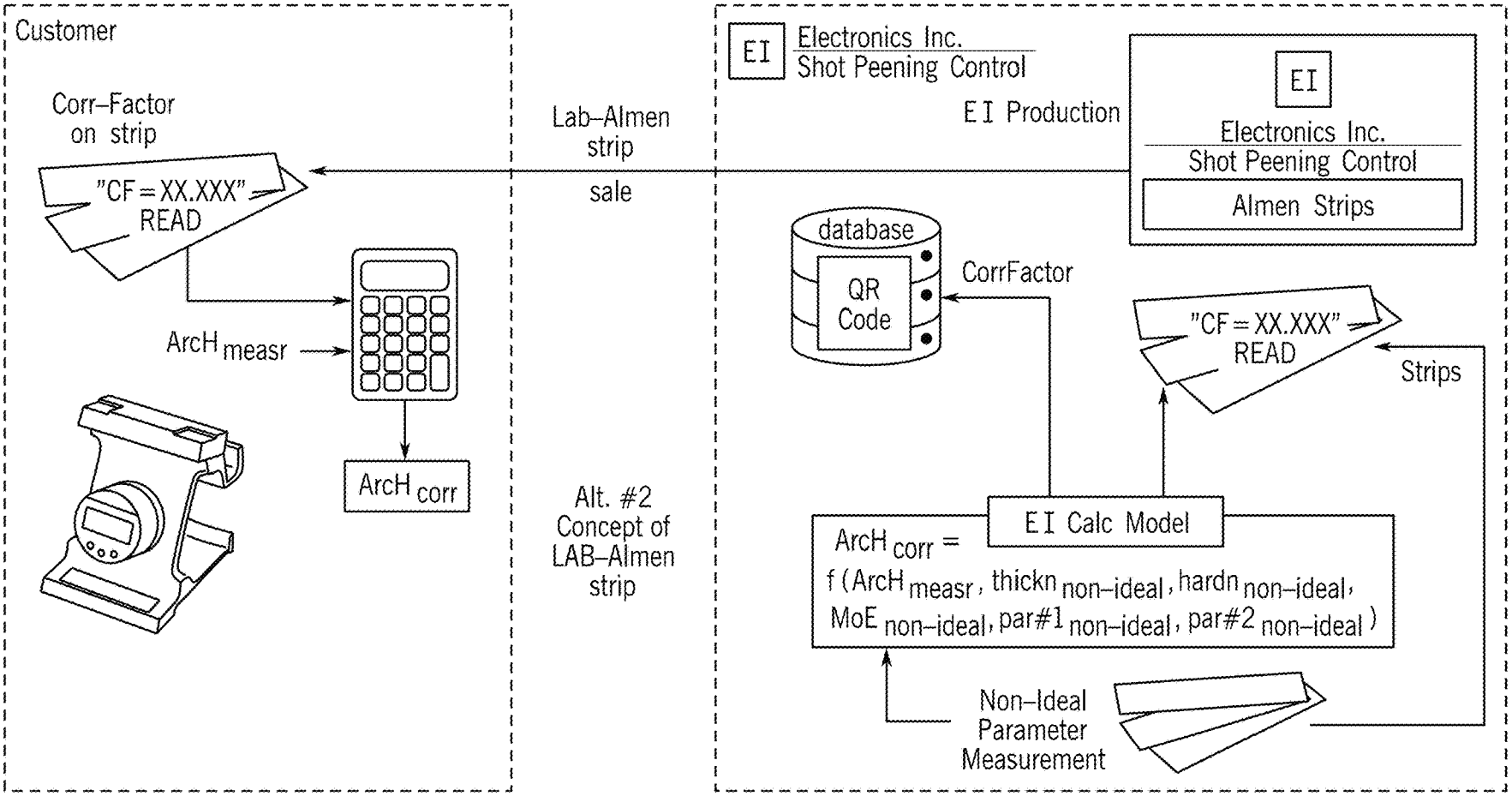
FIG. 10 is an example embodiment of applying compensation to a testing environment using the system of FIG. 1.
Figure 11:
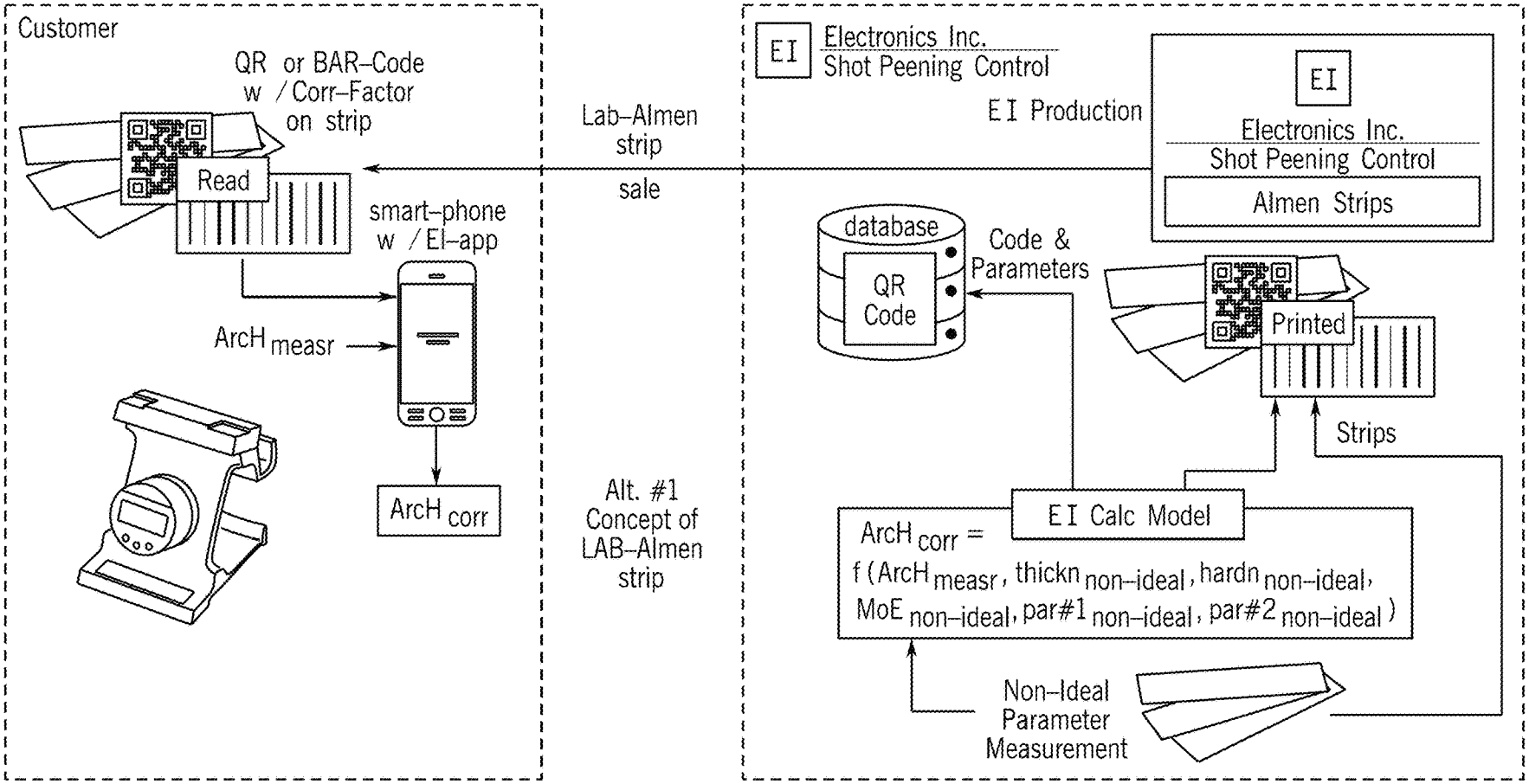
FIG. 11 is an example embodiment of applying compensation to a testing environment using the system of FIG. 1.
Figure 12:
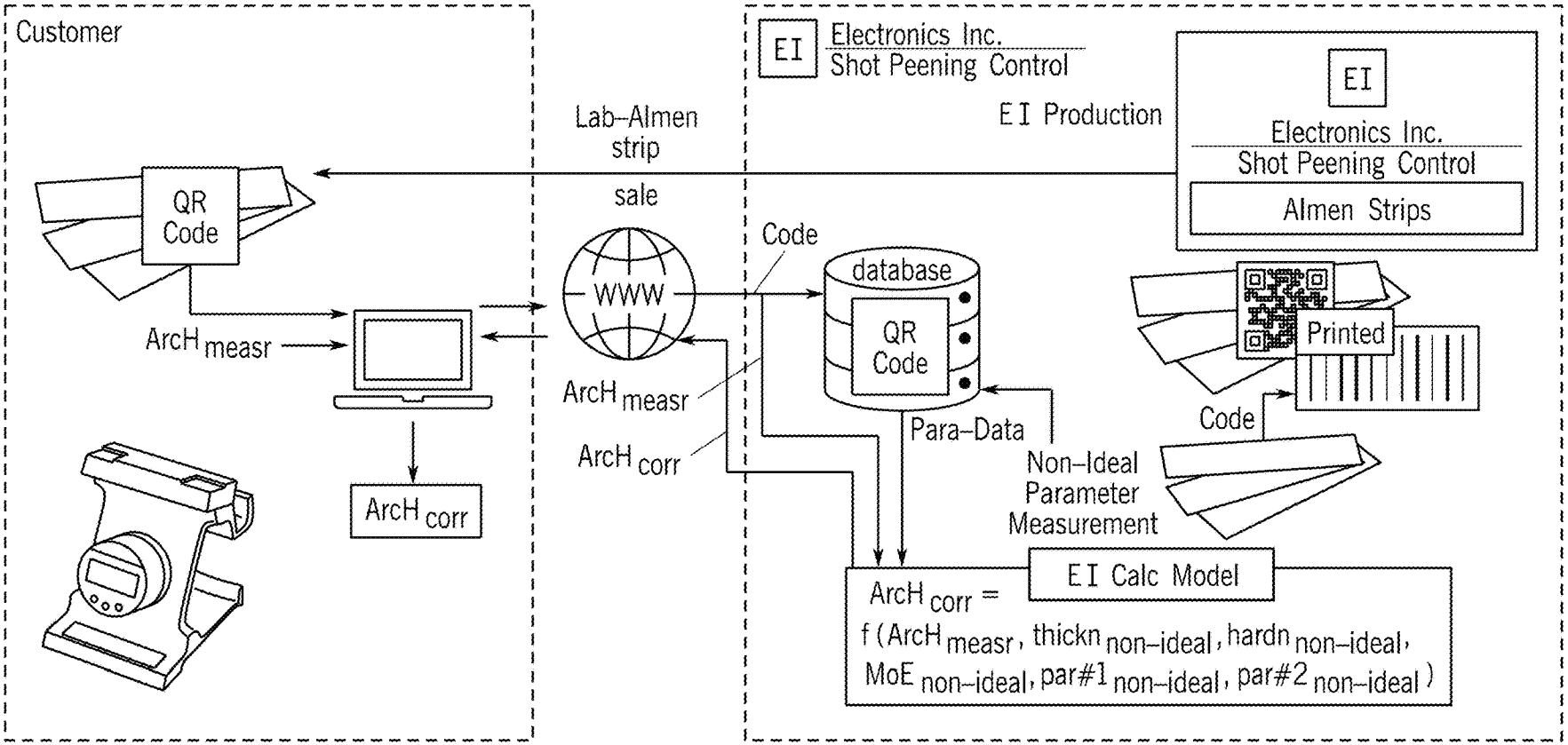
FIG. 12 is an example embodiment of applying compensation to a testing environment using the system of FIG. 1.

FIG. 9 shows an example where a correction factor for a desired parameter or parameters (e.g., thickness, hardness, etc.) may be encoded onto a machine readable code onto the Almen strip itself. In this way, the code may be read by a non-internet connected device, for example, and that device may decode the correction factor to be applied to the Almen strip saturation point as-measured from a shot peening intensity test. In various examples, a correction factor may not be encoded in a machine readable code, and additionally or alternatively be printed on the Almen strip as in FIG. 10, associated packaging, etc. so that the customer or user may apply a correction factor to a test result themselves. In various examples, the computing device may itself be programmed with instructions to apply a correction factor read via a machine readable code or otherwise input via other means, such as via manual input by a user. In various examples, an Almen strip gauge may be configured to read a code with correction factor information or linking information to a manufacturer device, such that a separate computing device as shown in FIGS. 7-12 may not be used, and rather an Almen strip gauge may be configured to read a machine readable code, communicate with a manufacturer system, apply a correction factor, etc. FIG. 11 may similarly read information printed on the Almen strip or associated packaging and display or output a correction factor and/or a corrected saturation point. In examples where a device such as that shown in FIG. 11 may output a corrected saturation point (e.g., where the device actually applies the correction factor), the device may also be configured to receive (e.g., from a user input, from another device, etc.) the initial saturation point prior to correction, so that the correction factor may be applied to output a final, corrected or compensated saturation point value. FIG. 12 is similar to FIG. 7, except that a laptop computer is used instead of a mobile computing device.

What is claimed:

1. A method for calibrating a shot peening device comprising:

receiving, by a controller, one or more parameters representative of the shot peening device;

receiving, by the controller, one or more parameters representative of a test strip for use with the shot peening device;

determining, by the controller, a compensation value for the test strip based on the one or more parameters representative of the shot peening device and on the one or more parameters representative of the test strip;

receiving, by the controller, an arc height of the test strip following an introduction of the test strip into a shot stream generated by the shot peening device;

generating, by the controller, a compensated curvature value based on the compensation value and the arc height; and presenting, by the controller, a calibration suggestion based on the compensated curvature value.

2. The method of claim 1, wherein receiving the one or more parameters representative of the shot peening device comprises:

scanning a code printed on the shot peening device; and retrieving the one or more parameters from a database linked to the code.

3. The method of claim 1, wherein the one or more parameters representative of the shot peening device comprise:

a quality of media used by the shot peening device;

a size of the media;

a type of the media;

a hardness of the media;

an air pressure of the shot peening device;

a humidity of air pressurized by the shot peening device;

a size of a nozzle of the shot peening device;

a wear of the nozzle;

a size of a blast hose of the shot peening device;

a wear of the blast hose;

an ambient barometric pressure;

an arrangement of the shot peening device relative to the test strip; or an intensity level of the shot peening.

4. The method of claim 1, wherein receiving the one or more parameters representative of the test strip comprises:

scanning a code printed on the test strip; and retrieving the one or more parameters from a database linked to the code.

5. The method of claim 1, wherein the one or more parameters representative of the test strip comprise:

a thickness of the test strip;

a hardness of the test strip;

a width of the test strip;

a length of the test strip;

a chemical composition of the test strip;

a surface roughness of the test strip;

a magnetic property of the test strip;

a residual surface stress of the test strip;

a subsurface residual stress of the test strip;

an edge form of the test strip;

a decarburization level of the test strip; or a pre-bow amount of the test strip.

6. The method of claim 1, further comprising:

receiving, by the controller, one or more parameters representative of an operator of the shot peening device, wherein the compensation value is further determined based on the one or more parameters representative of the operator.

7. The method of claim 6, wherein the one or more parameters representative of the operator comprise:

an accuracy of a measurement device used to determine the arc height;

a side of the test strip that is measure;

a flatness of a test strip holder; or a torque of a screw affixing the test strip to the test strip holder.

8. The method of claim 1, further comprising:

storing, by the controller, the compensation value; and applying, by the controller, the compensation value to subsequent arc heights derived from a subsequent introduction of test strips into the shot stream of the shot peening device.

9. A system for calibrating a shot peening device, the system comprising:

a processor; and computer-readable media storing instructions that, when executed by the processor, cause the system to:

receive one or more parameters representative of the shot peening device;

receive one or more parameters representative of a test strip for use with the shot peening device;

determine a compensation value for the test strip based on the one or more parameters representative of the shot peening device and on the one or more parameters representative of the test strip;

receive an arc height of the test strip following an introduction of the test strip into a shot stream generated by the shot peening device;

generate a compensated curvature value based on the compensation value and the arc height; and present a calibration suggestion based on the compensated curvature value.

10. The system of claim 9, wherein receiving the one or more parameters representative of the shot peening device comprises:

scanning a code printed on the shot peening device; and retrieving the one or more parameters from a database linked to the code.

11. The system of claim 9, wherein the one or more parameters representative of the shot peening device comprise:

a quality of media used by the shot peening device;

a size of the media;

a type of the media;

a hardness of the media;

an air pressure of the shot peening device;

a humidity of air pressurized by the shot peening device;

a size of a nozzle of the shot peening device;

a wear of the nozzle;

a size of a blast hose of the shot peening device;

a wear of the blast hose;

an ambient barometric pressure;

an arrangement of the shot peening device relative to the test strip; or an intensity level of the shot peening.

12. The system of claim 9, wherein receiving the one or more parameters representative of the test strip comprises:

scanning a code printed on the test strip; and retrieving the one or more parameters from a database linked to the code.

13. The system of claim 9, wherein the one or more parameters representative of the test strip comprise:

a thickness of the test strip;

a hardness of the test strip;

a width of the test strip;

a length of the test strip;

a chemical composition of the test strip;

a surface roughness of the test strip;
a magnetic property of the test strip;
a residual surface stress of the test strip;
a subsurface residual stress of the test strip;
an edge form of the test strip;
a decarburization level of the test strip; or
a pre-bow amount of the test strip.

14. The system of claim 9, wherein the instructions further cause the system to:
receive one or more parameters representative of an operator of the shot peening device,
wherein the compensation value is further determined based on the one or more parameters representative of the operator.

15. The system of claim 14, wherein the one or more parameters representative of the operator comprise:
an accuracy of a measurement device used to determine the arc height;
a side of the test strip that is measure;
a flatness of a test strip holder; or
a torque of a screw affixing the test strip to the test strip holder.

16. The system of claim 9, wherein the instructions further cause the system to:
store the compensation value; and
apply the compensation value to subsequent arc heights derived from a subsequent introduction of test strips into the shot stream of the shot peening device.

17. A non-transitory computer-readable medium storing instructions that, when executed by a processor, cause a computer system to perform operations comprising:
receive one or more parameters representative of a shot peening device;
receive one or more parameters representative of a test strip for use with the shot peening device;
determine a compensation value for the test strip based on the one or more parameters representative of the shot peening device and on the one or more parameters representative of the test strip;
receive an arc height of the test strip following an introduction of the test strip into a shot stream generated by the shot peening device;
generate a compensated curvature value based on the compensation value and the arc height; and
present a calibration suggestion based on the compensated curvature value.

18. The system of claim 17, wherein receiving the one or more parameters representative of the shot peening device comprises:
scanning a code printed on the shot peening device; and
retrieving the one or more parameters from a database linked to the code.

19. The system of claim 17, wherein the one or more parameters representative of the shot peening device comprise:
a quality of media used by the shot peening device;
a size of the media;
a type of the media;
a hardness of the media;
an air pressure of the shot peening device;
a humidity of air pressurized by the shot peening device;
a size of a nozzle of the shot peening device;
a wear of the nozzle;
a size of a blast hose of the shot peening device;
a wear of the blast hose;
an ambient barometric pressure;
an arrangement of the shot peening device relative to the test strip; or
an intensity level of the shot peening.

20. The system of claim 17, wherein receiving the one or more parameters representative of the test strip comprises:
scanning a code printed on the test strip; and
retrieving the one or more parameters from a database linked to the code.

21. The system of claim 17, wherein the one or more parameters representative of the test strip comprise:
a thickness of the test strip;
a hardness of the test strip;
a width of the test strip;
a length of the test strip;
a chemical composition of the test strip;
a surface roughness of the test strip;
a magnetic property of the test strip;
a residual surface stress of the test strip;
a subsurface residual stress of the test strip;
an edge form of the test strip;
a decarburization level of the test strip; or
a pre-bow amount of the test strip.

22. The system of claim 17, wherein the instructions further cause the system to:
receive one or more parameters representative of an operator of the shot peening device,
wherein the compensation value is further determined based on the one or more parameters representative of the operator.

23. The system of claim 20, wherein the one or more parameters representative of the operator comprise:
an accuracy of a measurement device used to determine the arc height;
a side of the test strip that is measure;
a flatness of a test strip holder; or
a torque of a screw affixing the test strip to the test strip holder.

* * * * *